United States Patent [19]

Franzmann

[11] 4,044,645

[45] Aug. 30, 1977

[54] DEVICE FOR CONTINOUS PITCH VARIATION OF STRINGED INSTRUMENTS

[76] Inventor: Rainer Franzmann, Mittelstrasse 24, 2000 Norderstedt 2, Germany

[21] Appl. No.: 613,803

[22] Filed: Sept. 16, 1975

[30] Foreign Application Priority Data

Nov. 21, 1974 Germany ..... 2445181
Feb. 20, 1975 Germany ..... 2507285

[51] Int. Cl.[2] ..... G10D 3/00
[52] U.S. Cl. ..... 84/313
[58] Field of Search ..... 84/267, 293, 312, 313

[56] References Cited

U.S. PATENT DOCUMENTS

| | | | |
|---|---|---|---|
| 1,755,019 | 4/1930 | Parker | 84/293 |
| 3,185,011 | 5/1965 | Anderson | 84/293 |
| 3,748,943 | 7/1973 | Lashley | 84/312 |

FOREIGN PATENT DOCUMENTS

| | | | |
|---|---|---|---|
| 1,597,028 | 3/1970 | Germany | 84/293 |
| 751,814 | 7/1956 | United Kingdom | 84/293 |

*Primary Examiner*—Lawrence R. Franklin
*Attorney, Agent, or Firm*—Stonebraker, Shepard & Stephens

[57] ABSTRACT

A device for continous pitch variation has rotary support means which connect the extension piece of the neck flexibly with the body of the instrument. A string holder is mounted on one rotary support lever and has adjustable holding elements for each string. A system of levers transmits the tension of the strings over an adjustable point of force transmission to a tension spring. The tension spring has an adjustable seat.

6 Claims, 6 Drawing Figures

DEVICE FOR CONTINOUS PITCH VARIATION OF STRINGED INSTRUMENTS

SUMMARY OF THE INVENTION

This application relates to devices for continous pitch variation of stringed instruments by which the neck can be slid relative the body whereby the tension of strings is changed by means of a special mechanical device. Such devices have been described in my German patent application P 15,97,028.2.

One of the objects of the invention is to provide a device for continous pitch variation in which the movable part which connects the extension piece of the neck with the body especially sturdy and easy to slide.

Another object is to provide a device for continous pitch variation in which the lever arm of the strings is adjustable at the string holder whereby the user can regulate the sliding force and travel according to his own wish.

Another object is to provide a device for continous pitch variation in which the force exerted by the tension of the strings on the tension spring can be regulated by the user.

Another object is to provide a device for continous pitch variation in which the seat of the tension spring is adjustable whereby the user can regulate the position of the neck. These and further objects and advantages of this invention will become apparent from the following description and drawings, taking together with the claims.

DETAILED DESCRIPTION

The drawings show a special application of the invention, in this case an electric guitar. It should be understood that the shown components of the device are only one possible mode of application. Other components varied from this can also obtain the same mode of action. The shown components are preferably made of metal.

Figure 1:
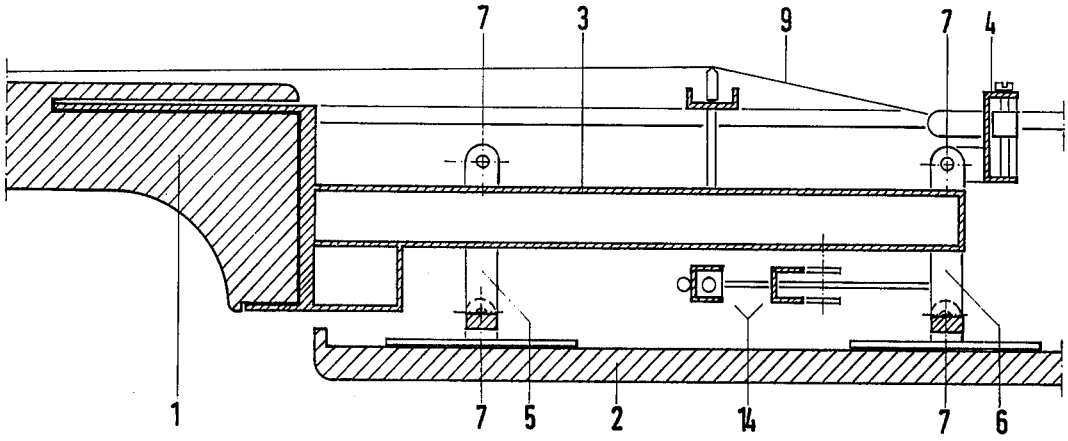
FIG. 1 shows a longitudinal section view of the device.
Figure 2:
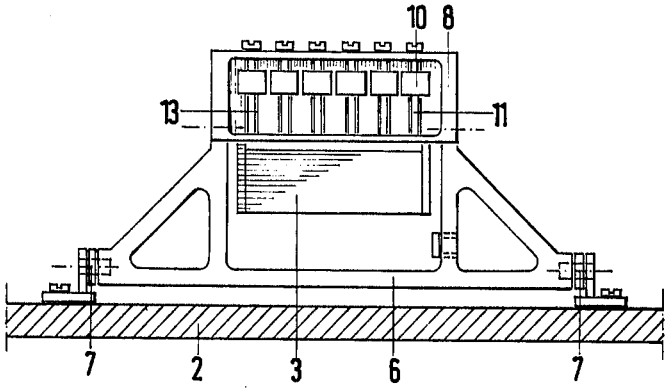
FIG. 2. shows a rear elevational view of the string holder with the rotary support.

FIG. 1 shows a guitar with its neck 1 and its body 2. The neck 1 can be slid parallel to its axis relative to the body 2. The sliding is done by the left hand when playing. The neck 1 is lengthened by the extension piece 3 up to the string holder 4. The connection of the neck 1 and the body 2, which must be sturdy and at the same time easily movable, consists of rotary support means including two rotary support levers 5 and 6. Each of these rotary support levers 5 and 6 has bearings 7 at its ends which accomplish the mobility. The lower bearings 7 (FIG. 1) pivot the support levers 5 and 6 to the body 2 and the upper bearings 7 pivot these support levers to the neck extension 3. The string holder 4 is mounted firmly on the rotary support 6.

Figure 3:
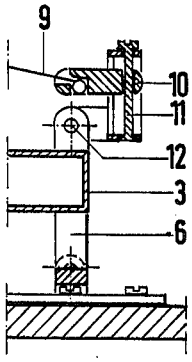
FIG. 3 shows a longitudinal vertical section view of the string holder with the rotary support.
Figure 4:
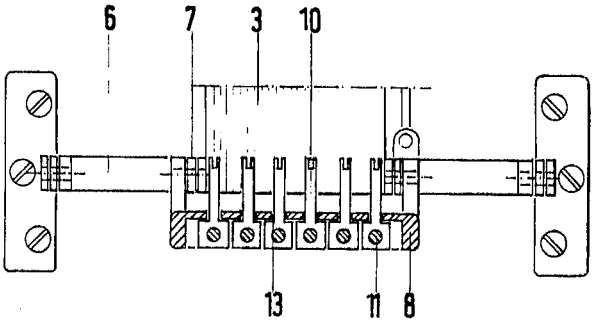
FIG. 4 shows a view partly in plan and partly in horizontal section of the string holder with the rotary support.
Figure 5:
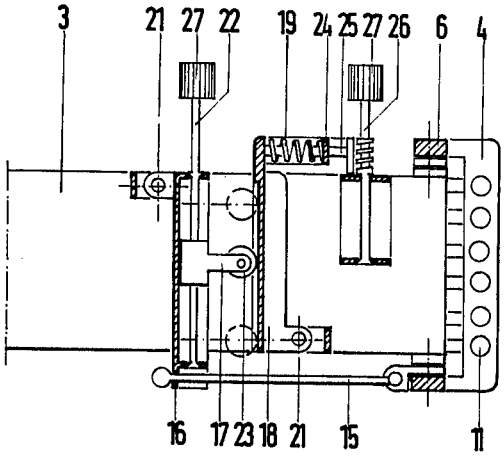
FIG. 5 shows a horizontal section view of the system of levers mounted on the extension piece.

FIGS. 3, 4 and 5 show the string holder 4 which has a box frame 8. Each string 9 has its own holding element 10. The holding elements 10 are placed in the recess of the box frame 8 and held by screws 11. By turning these screws 11 the holding elements 10 can be moved relative to the rotation axis 12 of the rotary support 6. In this way the lever arm of each string can be adjusted continously by the user. The holding elements 10 extend through special slots 13 in the box frame 3. The ends of these holding elements 10 hold the strings 9. The box frame 8 is so mounted on the rotary support 6 that the holding elements 10 are situated above the rotation axis 12 of the rotary support 6.

Figure 6:
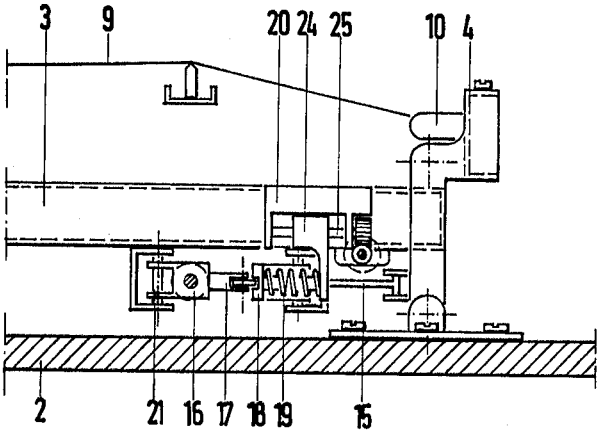
FIG. 6 shows a left side elevational view of the system of levers mounted on the extension piece.

FIGS. 5 and 6 show a system of levers 14 which consists of a pull rod 15, a primary lever 16, a push rod 17, a secondary lever 18, and a tension spring 19 with its fixing block 20. These levers 16 and 18 may be referred to for convenience as compensating levers, to distinguish them from the previously mentioned support levers 5 and 6. The pull rod 15 which connects the rotary support 6 with the free end of the primary lever 16 transmits the tension from the rotary support 6 to the primary lever 16. The primary lever 16 and the secondary lever 18 are mounted on the extension piece 3 of the neck by alternately placed bearings 21. The push rod 17 transmits the tension from the primary lever 16 to the secondary lever 18. The push rod 17 is mounted on the primary lever 16 and held by a screw 22. By turning this screw 22 the push rod 17 can be moved along the primary lever 16, whereby the point of force transmission can be changed by the user. For easier movement the push rod 17 can have a roller 23. The free end of the secondary lever 18 lies against the tension spring 19. The tension spring 19 is fastened to the spring arm 24. This spring arm 24 is held in its fixing block 20 by a screw 25. By turning this screw 25 the spring arm 24 can be moved relative to the free end of the secondary lever 18, whereby the user can change the position of the tension spring 19. For better accessibility the screw 25 can be propelled by a worm drive 26. The screw 22 of the push rod 17 and the worm drive 26 can have knobs 27 for easier handling.

The mode of action of a device with the above mentioned components is the following: By stretching and tuning the strings a torque is created around the rotation axis of the rotary support. Different positions of the holding elements produce different tensile forces in the pull rod. By adjusting the positions of the push rod the point of force transmission from the primary lever to the secondary lever and with that the transmission ratio can be regulated so that the tension spring always gets an ideal load. Through this a smooth action of the device is guaranteed even when the tension of the strings is increased. The tension spring bears the transmitted tension so that the summary of all torques is zero. Thereby the tuning of the strings is stablized. When the position of the spring arm 24 is changed all rotation angles can be regulated. Thereby the position of the neck can be regulated perfectly.

If the user slides the neck, the rotary support lever 6 will be rotated about rotational axis 12, thereby rotating string holder 4 about axis 12, changing the distance between neck 1 and string holder 4, and with that the tension and the pitch of the strings change. Sliding the neck towards the body raises the pitch and vice versa. By changing the position of the holding elements 10 the user can regulate the sliding force and travel accordings to his own wishes.

While the invention has been described, it will be understood that it is capable of further modifications and this application is intended to cover any variations, uses, or adaptions of the invention following in general, the principles of the invention and including such departures from the present disclosure as come within known or customary practice in the art to which the invention pertains, and as may be applied to the essential features herinbefore set forth and as fall within the scope of the invention or the limits of the appended claims.

I claim:

1. A stringed musical instrument comprising:

a neck, a body, and a plurality of tuned strings extending over said neck and body, said neck having an extension extending into said body;

rotary support including at least one support lever pivotally connected both to said body and said neck extension to rotate about a body rotation axis and a neck extension rotation axis, respectively, said rotary support means being so arranged that said neck extension may move longitudinally relative to said body to rotate said support lever;

string holder means firmly mounted on said support lever for holding one end of said strings, said string holder means rotating with said support lever about said neck extension rotation axis to vary the tension of said strings; and compensating means connected to said neck extension and said support lever for zeroing the torque on said support lever created by the tension of said tuned strings.

2. An instrument as defined in claim 1, wherein said rotary support means includes a second support lever pivoted to said neck extension about a second neck extension rotation axis spaced longitudinally along the length of said neck extension from the first mentioned neck extension rotation axis.

3. An instrument as defined in claim 1, wherein said string holder means includes a string holding element for each string for holding said one end of said string, said string holding element having means for adjusting the distance of said string one end from said neck extension rotations axis; and the other end of each of said strings being attached to tuning means on the end of said neck remote from said neck extension.

4. An instrument as defined in claim 1, wherein said compensating means is spring biased and further includes means for adjusting the compensating force exerted by said biasing spring.

5. An instrument as defined in claim 1, wherein said compensating means includes a primary lever connected to said support lever, a secondary lever, a spring biasing said secondary lever toward said primary lever, means for adjusting the force exerted by said spring on said secondary lever, and transmission means for transmitting force between said primary and secondary levers.

6. An instrument as defined in claim 5, wherein said transmission means includes means for adjusting the amount of force transmitted between said primary and secondary levers.

* * * * *